US005464525A

United States Patent [19]

Edmonson

[11] Patent Number: 5,464,525

[45] Date of Patent: Nov. 7, 1995

[54] HIGH TEMPERATURE CORROSION INHIBITOR

[75] Inventor: James G. Edmonson, Conroe, Tex.

[73] Assignee: Betz Laboratories, Inc., Trevose, Pa.

[21] Appl. No.: 354,692

[22] Filed: Dec. 13, 1994

[51] Int. Cl.[6] ..... C10G 9/16

[52] U.S. Cl. ..... 208/47; 208/48 AA; 585/950

[58] Field of Search ..... 208/47, 48 AA; 585/950

[56] References Cited

U.S. PATENT DOCUMENTS

| | | | |
|---|---|---|---|
| 4,906,751 | 3/1990 | Schneider | 544/213 |
| 4,931,196 | 6/1990 | Payne et al. | 252/47.5 |
| 4,941,994 | 7/1990 | Zethmeisl et al. | 252/389.23 |
| 5,182,013 | 1/1993 | Peterson et al. | 208/348 |
| 5,252,254 | 10/1993 | Babaian-Kibala | 252/393 |
| 5,314,643 | 5/1994 | Edmondson | 252/389.23 |

*Primary Examiner*—Asok Pal
*Assistant Examiner*—Bekir L. Yildirim
*Attorney, Agent, or Firm*—Alexander D. Ricci; Richard A. Paikoff

[57] ABSTRACT

A process for the inhibition of corrosion caused by naphthenic acid during the elevated temperature processing of crude oil or the high temperature distillates derived therefrom by use of a treatment comprising a mercaptotriazine compound.

4 Claims, No Drawings

HIGH TEMPERATURE CORROSION INHIBITOR

FIELD OF THE INVENTION

This invention relates generally to a process for inhibiting corrosion in refining operations. It is specifically directed toward the inhibition of corrosion caused by naphthenic acids which are present in the crude oil.

BACKGROUND OF THE INVENTION

Corrosion problems in petroleum refining operations associated with naphthenic acid constituents in crude oils have been recognized for many years. Such corrosion is particularly severe in atmospheric and vacuum distillation units at temperatures between 350° F. and 790° F. Other factors that contribute to the corrosivity of crudes containing naphthenic acids include the amount of naphthenic acid present, the concentration of sulfur compounds, the velocity and turbulence of the flow stream in the units, and the location in the unit (e.g., liquid/vapor interface).

In the distillation refining of crude oils, the crude oil is passed successively through a furnace and one or more fractionators such as an atmospheric tower and a vacuum tower. In most operations, naphthenic acid corrosion is not a problem at temperatures below about 350° F. Traditional nitrogen-based filming corrosion inhibitors are not effective at temperatures above 350° F. and the other approaches for preventing naphthenic acid corrosion such as neutralization present operational problems or are not effective.

It should be observed that the term "naphthenic acid" includes mono- and di-basic carboxylic acids and generally constitutes about 50% by weight of the total acidic components in crude oil. Many of the naphthenic acids may be represented by the following formula:

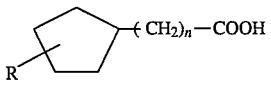

where R is an alkyl or cycloalkyl group and n ranges generally from 2 to 10.

Many variations of this structure and molecular weight are possible. Some practitioners include alkyl organic acids within the class of naphthenic acids.

Naphthenic acids are corrosive between the range of about 350° F. (180° C.) to 790° F. (420° C.). At the higher temperatures the naphthenic acids are in the vapor phase and the rate of decarboxylation increases; at the lower temperatures the corrosion rate is not serious. The corrosivity of crude oils and distillates is also affected by the presence of sulfide compounds, such as hydrogen sulfide, mercaptans, elemental sulfur, sulfides, disulfides, polysulfides and thiophenols. Corrosion due to sulfur compounds becomes significant at temperatures as low as 450° F. The catalytic generation of hydrogen sulfide by thermal decomposition of mercaptans has been identified as a cause of sulfidic corrosion.

Efforts to minimize or prevent the naphthenic acid corrosion have included the following approaches:

(a) blending of higher naphthenic acid content oil with oil low in naphthenic acids;

(b) neutralization and removal of naphthenic acids from the oil; and (c) use of corrosion inhibitors.

Because these approaches have not been entirely satisfactory, the accepted approach in the industry is to construct the distillation unit, or the portions exposed to naphthenic acid corrosion, with the resistant metals such as high quality stainless steel or alloys containing higher amounts of chromium and molybdenum. However, in units not so constructed there is a need to provide inhibition treatment against this type of corrosion. The prior art corrosion inhibitors for naphthenic acid environments include nitrogen-based filming corrosion inhibitors. However, these corrosion inhibitors are relatively ineffective in the high temperature environment of naphthenic acid oils.

Atmospheric and vacuum distillation systems are subject to naphthenic acid corrosion when processing certain crude oils. Currently used treatments are thermally reactive at use temperatures. In the case of phosphorus-based inhibitors, this is thought to lead to a metal phosphate surface film. The film is more resistant to naphthenic acid corrosion than the base steel. These inhibitors are relatively volatile and exhibit fairly narrow distillation ranges. They are fed into a column above or below the point of corrosion depending on the temperature range. Polysulfide inhibitors decompose into complex mixtures of higher and lower polysulfides and, perhaps, elemental sulfur and mercaptans. Thus, the volatility and protection offered is not predictable.

DETAILED DESCRIPTION OF THE INVENTION

The present invention provides a method for inhibiting the corrosion of the internal metallic surfaces of the equipment used in processing crude oil or the high temperature petroleum distillates derived therefrom. It comprises adding to the crude oil or distillates an effective amount, sufficient to inhibit corrosion of a mercaptotriazine compound. The mercaptotriazine compounds of the present invention are commercially available.

Through the use of the present invention, treatment may be fed to the crude charge, e.g., and provide protection in the lower crude tower and vacuum column.

The most effective amount of the corrosion inhibitor to be used in accordance with this invention can vary, depending on the local operating conditions and the particular hydrocarbon being processed. Thus, the temperature and other characteristics of the acid corrosion system can have a bearing on the amount of the inhibitor or mixture of inhibitors to be used. Generally, where the operating temperatures and/or the acid concentrations are higher, a proportionately higher amount of the corrosion inhibitor will be required. It has been found that the concentration of the corrosion inhibitor added to the crude oil may range from about 1 ppm to 5000 ppm, by volume. It has also been found that it is preferred to add the inhibitor at a relatively high initial dosage rate of 2000–3000 ppm and to maintain this level for a relatively short period of time until the presence of the inhibitor induces the build-up of a corrosion protective coating on the metal surfaces. The corrosion inhibitor may be added either neat or diluted. Once the protective surface is established, the dosage rate needed to maintain the protection may be reduced to a normal operational range of about 100–1500 ppm without substantial sacrifice of protection.

This invention will now be further described in the following examples, which are provided for illustration purposes and are not intended to act as a limitation thereof.

Example 1

A naphthenic acid corrosion test was conducted utilizing the 650° to 850° F. fraction of North Sea crude oil. A weight loss coupon immersion test was used to evaluate corrosion. The total acid number of the solution was 2.3 mg KOH/g. The crude fraction was heated to 565° F. after which the treatment of the invention was added. Two preweighed 1018 carbon steel coupons were then suspended in the hot oil on glass hooks for each run. After 18 to 20 hours of exposure (with continuous $N_2$ purge), the coupons were removed, cleaned up and reweighed. Weight losses for the coupons from the untreated (blank) run averaged 13.6 mils per year (mpy). Table I shows the results of 2,4,6-trimercapto-1,3,5-triazine, a preferred compound of the present invention compared to a simply alkyl mercaptan and a prior art dialkyl polysulfide, di-t-nonylpentasulfide (TNPS), at 440 ppm active.

TABLE I

| Corrosion Rate | |
|---|---|
| Compound | Corrosion (mpv) |
| Blank | 13.6 |
| hexadecyl mercaptan | 12.4 |
| TNPS | 9.2 |
| 2,4,6-trimercapto-1,3,5-triazine | 6.3 |

As shown in Table 1, the mercaptotriazine compound significantly reduced corrosion as compared to the prior art sulfur compounds and simple mercaptans that might be expected to occur naturally in crude oils and their distillates. Thus, the addition of a mercaptotriazine even in the presence of "reactive sulfur" (i.e., $H_2S$, mercaptans, elemental sulfur) will result in less corrosion in high temperature areas of the refinery.

Other mercaptotriazine compounds, such as sulfur-substituted mercaptotriazines wherein 1 or 2 of the mercapto hydrogens are replaced by e.g., alkyl, aryl, cycloalkyl, are also anticipated to be effective.

Note that current corrosion inhibitors include organic polysulfides, phosphorus containing, or sulfonated phenols. The polysulfide and sulfonated phenol treatments were developed in response to concerns regarding the potential effects of phosphorus compounds on certain catalysts used in subsequent processing of treated distillate streams. Furthermore, polysulfides are thermally unstable and decompose yielding a mixture of components of unknown volatility. The use of mercaptotriazines in the present invention displays known and controllable volatility, no phosphorus, and performance similar to polysulfide chemistries.

While the illustrative embodiments of the invention have been described with particularity, it will be understood that various other modifications will be apparent to those skilled in the art without departing from the spirit and scope of the invention.

What I claim is:

1. A method for inhibiting the naphthenic acid-induced corrosion of the internal metallic surfaces of the equipment used in the processing of crude oil or high temperature petroleum distillates between about 350° and 790° F. comprising adding to the crude oil or high temperature petroleum distillates a corrosion inhibiting amount of a mercaptotriazine compound.

2. The method of claim 1 wherein the amount of the mercaptotriazine compound added to the crude oil or distillates is an amount sufficient to generate a concentration of from about 1 to 5000 ppm, by volume.

3. The method of claim 2 wherein the concentration is from about 100 to 1500 ppm, by volume.

4. The method of claim 1 wherein said mercaptotriazine compound is 2,4,6 trimercapto-1,3,5-triazine.

* * * * *

UNITED STATES PATENT AND TRADEMARK OFFICE

CERTIFICATE OF CORRECTION

PATENT NO. : 5,464,525

DATED : Nov. 7, 1995

INVENTOR(S) : James G. Edmondson

It is certified that error appears in the above-identified patent and that said Letters Patent is hereby corrected as shown below:

On title page, item [19] change "Edmonson" to

--- Edmondson ---

On title page, item [75] should read as follows:

"Inventor: James G. Edmondson, Conroe, Tex."

Signed and Sealed this

Twenty-third Day of April, 1996

*Attest:*

Bruce Lehman

BRUCE LEHMAN

*Attesting Officer*

*Commissioner of Patents and Trademarks*